US007584725B2

(12) United States Patent
Ishimitsu

(10) Patent No.: US 7,584,725 B2
(45) Date of Patent: Sep. 8, 2009

(54) INTERNAL COMBUSTION ENGINE

(75) Inventor: Kengo Ishimitsu, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 132 days.

(21) Appl. No.: 11/976,611

(22) Filed: Oct. 25, 2007

(65) Prior Publication Data

US 2008/0105221 A1 May 8, 2008

Related U.S. Application Data

(60) Provisional application No. 60/854,454, filed on Oct. 26, 2006.

(51) Int. Cl.

| | |
|---|---|
| ***F01B 7/20*** | (2006.01) |
| ***F02B 75/24*** | (2006.01) |
| ***F02B 75/22*** | (2006.01) |

(52) U.S. Cl. ..... 123/50 R; 123/53.2; 123/55.2; 123/59.6

(58) Field of Classification Search ..... 123/47 R, 123/47 A, 47 AA, 47 AB, 50 R, 50 A, 50 B, 123/53.2, 54.1, 55.1, 55.2, 55.4–55.7, 59.6
See application file for complete search history.

(56) References Cited

U.S. PATENT DOCUMENTS 4,694,785 A * 9/1987 Timmerman et al. ..... 123/53.2

* cited by examiner

*Primary Examiner*—Noah Kamen
(74) *Attorney, Agent, or Firm*—Birch, Stewart, Kolasch & Birch, LLP

(57) ABSTRACT

An internal combustion engine wherein a combustion chamber is formed by moveably fitting a bottomed tubular moveable sleeve on a stationary piston in which a valve mechanism is incorporated, and the moveable sleeve is connected to a crankshaft via a connecting rod.

2 Claims, 12 Drawing Sheets

FRONT 37
36
36a
36d
36b
36h
43
43b
86
87
82
86
87
27
27a
19
44
43
87
43b
82
86
87
82
103
14
107
16
112
61A
26
18
26a
46
28
28a
82
87
86
86

FRONT
9
9
10
12
13
38
38b
41
42
43
43b
43d
43e
47
48
51
52
61
61A
61b
61d
61e
61f
61g
61h
63
66
71
72
74
75
76
77
78
81
82
83
84
86
87
88
90
91
91a
92
122

INTERNAL COMBUSTION ENGINE

FIELD OF THE INVENTION

The present invention relates to an internal combustion engine having a combustion chamber that is formed using a bottomed tubular moveable sleeve and a stationary piston with an internally held valve mechanism.

BACKGROUND OF THE INVENTION

In GB Patent No. 558115 there is proposed an opposed-piston internal combustion engine in which two pistons are moveably fitted in a cylinder so as to oppose one another, and two crankshafts are connected to the pistons via connecting rods.

As shown in FIG. 12 hereof, the two crankshafts 201, 202 are disposed in parallel in a crankcase 200. The cylinder 203 is provided to the crankcase 200 so as to be disposed between the crankshafts 201, 202, so that the cylinder axis is perpendicular to the crankshafts 201, 202. Pistons 204, 206 are moveably inserted into the cylinder 203 from openings on either end thereof. A yoke 207 is integrally formed with an end part of the piston 204. The yoke 207 is connected to the two crankshafts 201, 202 via connecting rods 208, 208. A yoke 211 is integrally formed with the end part of the piston 206. The yoke 211 is connected to the two crankshafts 201, 202 via connecting rods 212, 212. The spaces between the cylinder 203 and the pistons 204, 206 are sealed using a plurality of piston rings 214 attached on the pistons 204, 206. A combustion chamber 216 is formed between the two pistons 204, 206.

Since the piston rings 214 are attached on the pistons 204, 206, ring flutter occurs at high engine speeds from the piston rings 214 that vibrate within the ring grooves of the reciprocating pistons 204, 206. As a result of the ring flutter, during the power stroke, combustion gas in the combustion chamber 216 passes between the cylinder 203 and the pistons 204, 206; i.e., between the cylinder 203 and the piston rings 214. The gas is blown into the crankcase 200, and the amount of blow-by gas increases.

When the pistons 204, 206 move in a reciprocating manner, the volume of the crankcase 200 varies, and the pressure inside the crankcase 200 fluctuates. Therefore, when ring flutter occurs, oil mist inside the crankcase 200 passes between the cylinder 203 and the pistons 204, 206, i.e., between the piston rings 214 and the cylinder 203 during the intake stroke, and readily penetrates into the combustion chamber 216.

A demand has accordingly arisen for an internal combustion engine in which it is possible to prevent the incidence of ring flutter, and oil mist penetrating into the combustion chamber.

SUMMARY OF THE INVENTION

According to the present invention, there is provided an internal combustion engine which comprises: two rotatable crankshafts horizontally disposed in an engine case in vertically spaced relation to each other; two stationary pistons disposed between the two crankshafts and extending perpendicularly to a plane that passes over axial lines of the two crankshafts; moveable sleeves slidably attached to the respective stationary pistons; and combustion chambers surrounded by the stationary pistons and the moveable sleeves, wherein each of the stationary pistons has a piston ring disposed on a exterior surface thereof for sealing between the stationary piston and the respective moveable sleeve, and the two crankshafts and the two moveable sleeves are connected via respective connecting rods.

Since piston rings are mounted on the stationary pistons, inertial force does not act on the piston rings when the pistons move back and forth, ring flutter does not occur, and it is possible to prevent an increase in blow-by gas, and oil mist from penetrating to the combustion chamber.

In a preferred form, the engine case includes a case cylinder in which the moveable sleeves are moveably fitted, and an upper wall for blocking an end part of the case cylinder. Each of the moveable sleeves desirably includes a seal ring disposed on an outer surface thereof for sealing between the moveable sleeve and the case cylinder. The moveable sleeve, the case cylinder and the upper wall jointly define an intake chamber for admitting a mixed gas containing fuel and air, so that the mixed gas is supplied from the intake chamber to the combustion chamber.

Since the moveable sleeves merely slide and move along stationary pistons and case cylinders, the volume inside the crankcase does not vary. Therefore, the pressure within the crankcase does not vary. It is therefore possible to prevent oil mist from penetrating through to the combustion chamber from the crankcase.

BRIEF DESCRIPTION OF THE DRAWINGS

A preferred embodiment of the present invention will be described in detail below with reference to the accompanying drawings, in which.

DETAILED DESCRIPTION OF THE PREFERRED EMBODIMENT

Figure 1:
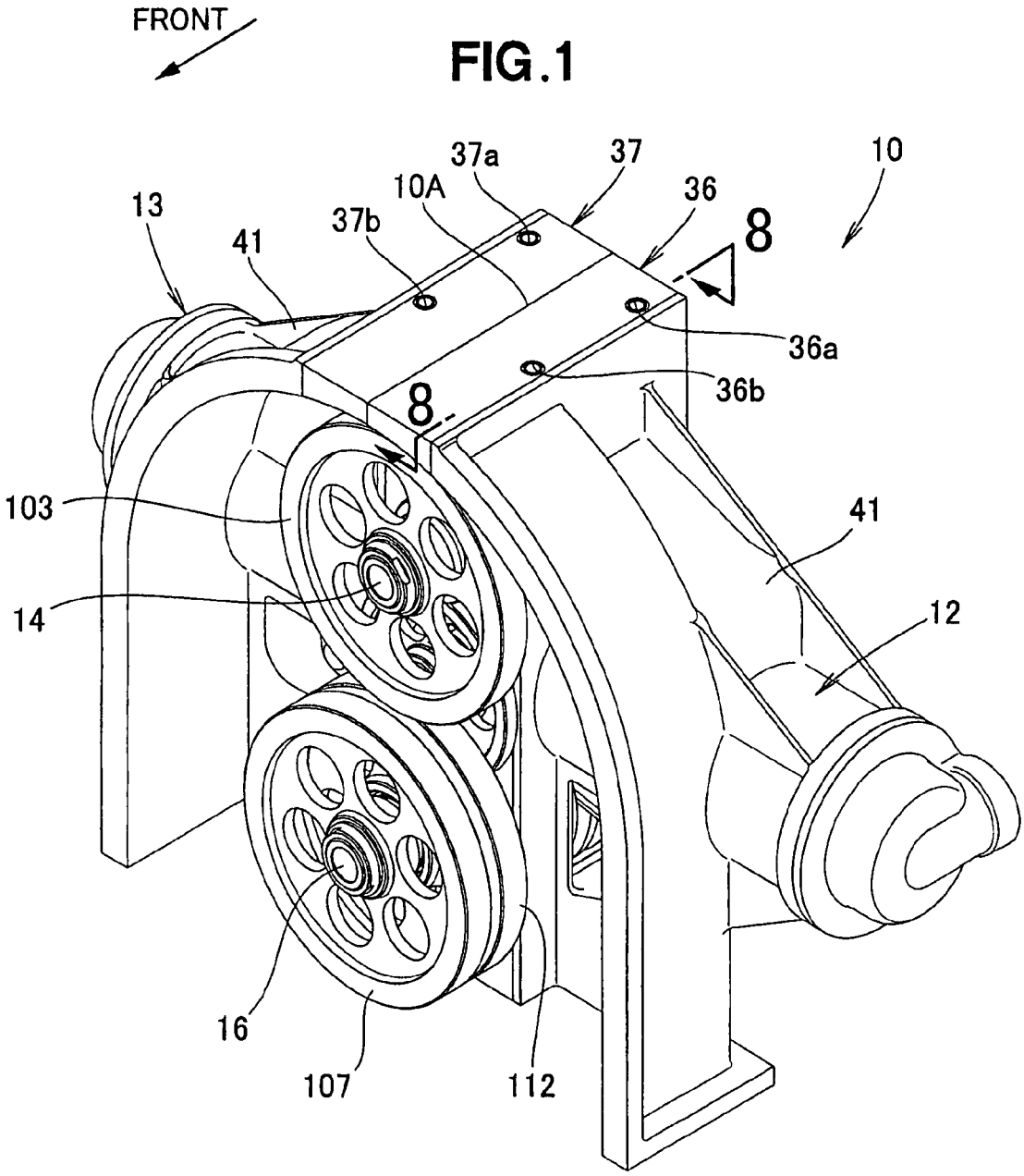
FIG. 1 is a perspective view showing an internal combustion engine according to the present invention.

As shown in FIG. 1, an internal combustion engine 10 is a drive source having the following configuration. A vertically disposed upper crankshaft 14 and lower crankshaft 16 are rotatably attached via a bearing so as to be held at a surface 10A in which two horizontally separated left and right fixed blocks 36, 37 are joined. Engine cases 41 are attached to side surfaces of the left fixed block 36 and the right fixed block 37. The left and right engine cases 41 constitute a left cylinder 12 and a right cylinder 13 that extend horizontally leftward and rightward. An upper crank output gear 103 is attached on a distal end of the upper crankshaft 14. An idler gear 112 that is rotatably supported on the lower crankshaft 16 meshes with the upper crank output gear 103. A lower crank output gear 107 is attached on a distal end of the lower crankshaft 16.

The reference numbers 36*a*, 37*a* and 36*b*, 37*b* in FIG. 1 designate coolant inlets and coolant outlets provided to upper surfaces of the left fixed block 36 and the right fixed block 37. The coolant inlets 36*a*, 37*a* and the coolant outlets 36*b*, 37*b* are connected to a water pump and a radiator (not shown), and coolant is circulated through these inlets and outlets within the internal combustion engine 10 (i.e., inside the left fixed block 36 and the right fixed block 37) via the water pump and the radiator.

Moveable sleeves that are connected to connecting rods are disposed on the upper crankshaft 14 and the lower crankshaft 16 in the left and right engine cases 41, 41 so as to be able to move in the horizontal direction. A throttle body, an air cleaner, and other intake devices are connected to rear portions of end parts of the left and right engine cases 41, 41 via an intake manifold. Inner teeth of a ring gear mesh with the idler gear 112 and the lower crank output gear 107. An output shaft via which output is transferred to the exterior is attached on the ring gear.

Figure 2:
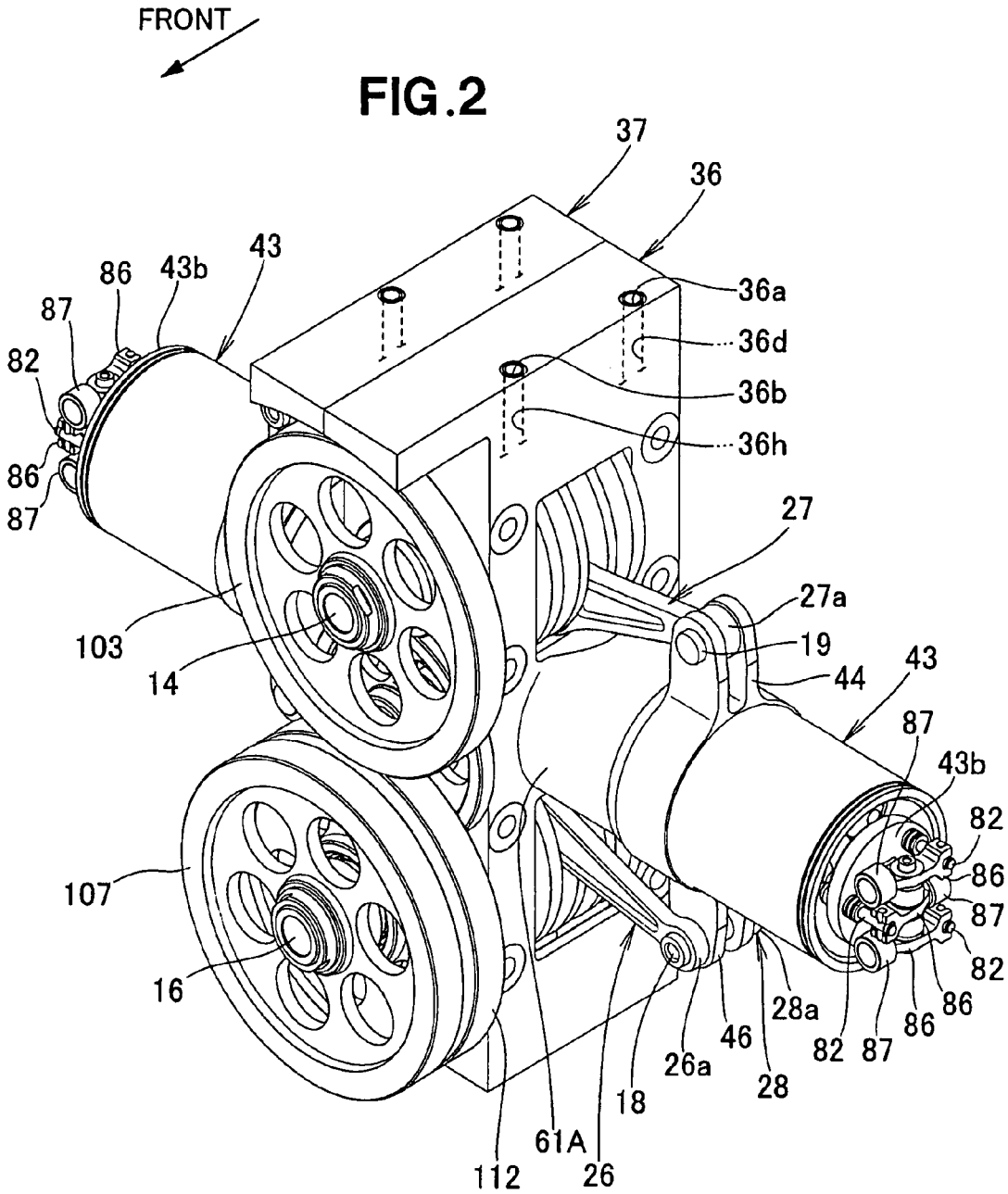
FIG. 2 is a perspective view showing a state in which an engine case of the internal combustion engine has been removed.

FIG. 2 shows a state in which the left and right engine cases 41, 41 shown in FIG. 1 have been removed.

The moveable sleeves 43 are moveably fitted on stationary pistons 61A (only the stationary piston 61A in the left fixed block 36 is shown) that horizontally protrude from either side of the left fixed block 36 and the right fixed block 37. The left moveable sleeve 43 is connected via connecting pins 18, 19 to small end parts 26*a*, 27*a*, 28*a* of connecting rods 26, 27, 28. The connecting rods extend leftward from within the left fixed block 36 and the right fixed block 37. Similarly, the right moveable sleeve 43 is connected via connecting pins 18, 19 to small end parts 26*a*, 27*a*, 28*a* of the connecting rods 26, 27, 28 (these connecting rods 26, 27, 28 are not shown). The connecting rods extend rightward from within the left fixed block 36 and the right fixed block 37.

Three intake valves 82 (only one intake valve 82 is shown in the right fixed block 37) are provided to a top part 43*b* of the moveable sleeve 43. One end of each of rocker arms 86 (only two rocker arms 86 are shown in the right fixed block 37), which have a middle part rotatably attached to the top part 43*b*, are connected to each end part of the intake valves 82. Weights 87 (only two weights 87 are shown in the right fixed block 37) for adjusting balance are attached on each of the other ends of the rocker arms 86.

Figure 3:
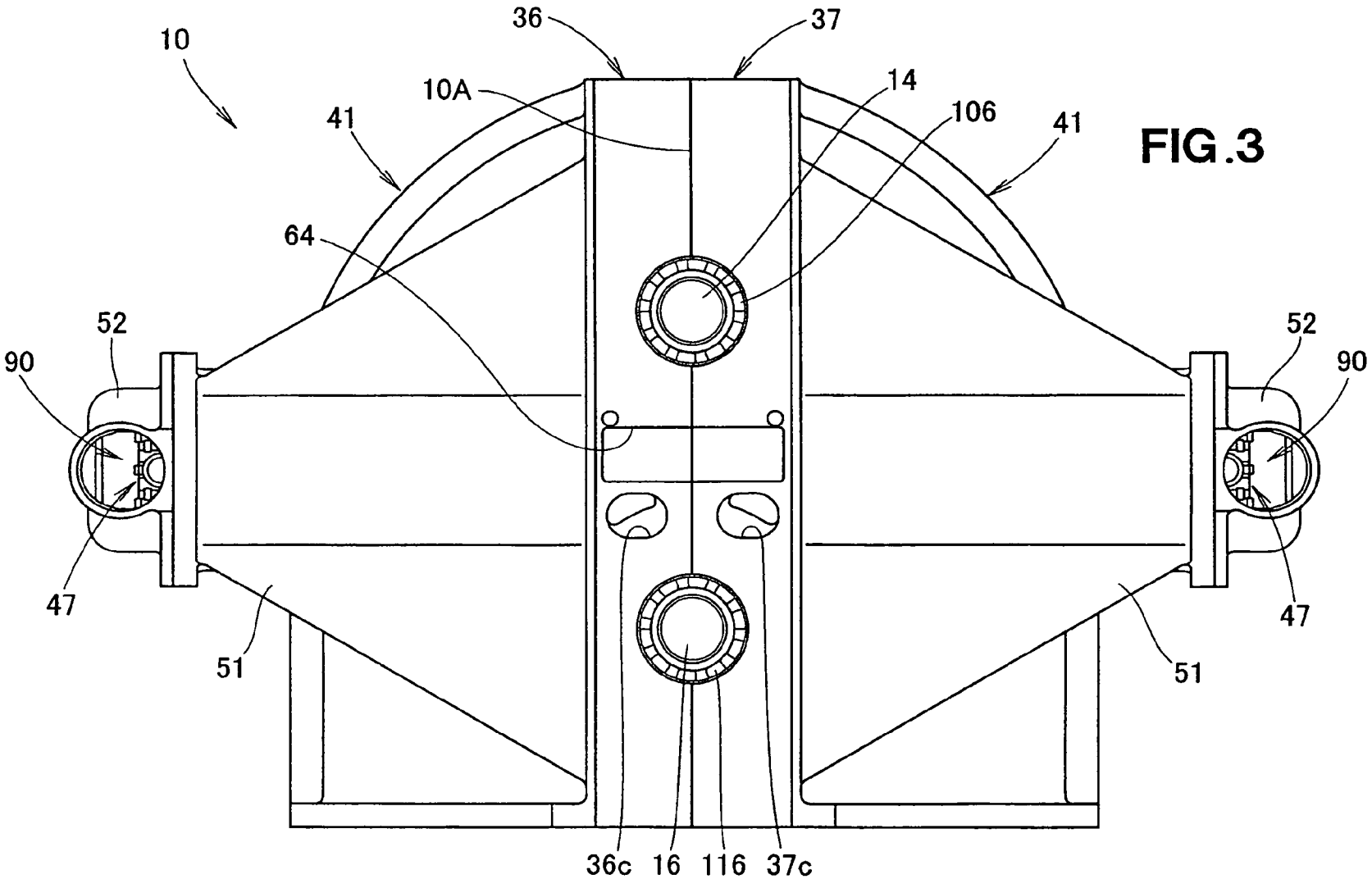
FIG. 3 is a rear view of the internal combustion engine.

As shown in FIG. 3, ball-bearings 106, 116 for rotatably supporting the upper crankshaft 14 and the lower crankshaft 16 are attached so as to be held at the joining surface 10A of the left and right fixed blocks 36, 37. A rectangular plug cord insertion opening 64 is formed along each of the left fixed block 36 and the right fixed block 37. A plug cord (not shown) connected to a spark plug (not shown) disposed inside each of the left and right fixed blocks is inserted via the plug cord insertion openings. Elliptical exhaust outlets 36*c*, 37*c* for discharging exhaust gas are formed in the left fixed block 36 and the right fixed block 37 below the plug cord insertion holes 64.

Exhaust pipes are connected to the exhaust outlets 36*c*, 37*c*, and a muffler is connected to the exhaust pipes.

Figure 4:
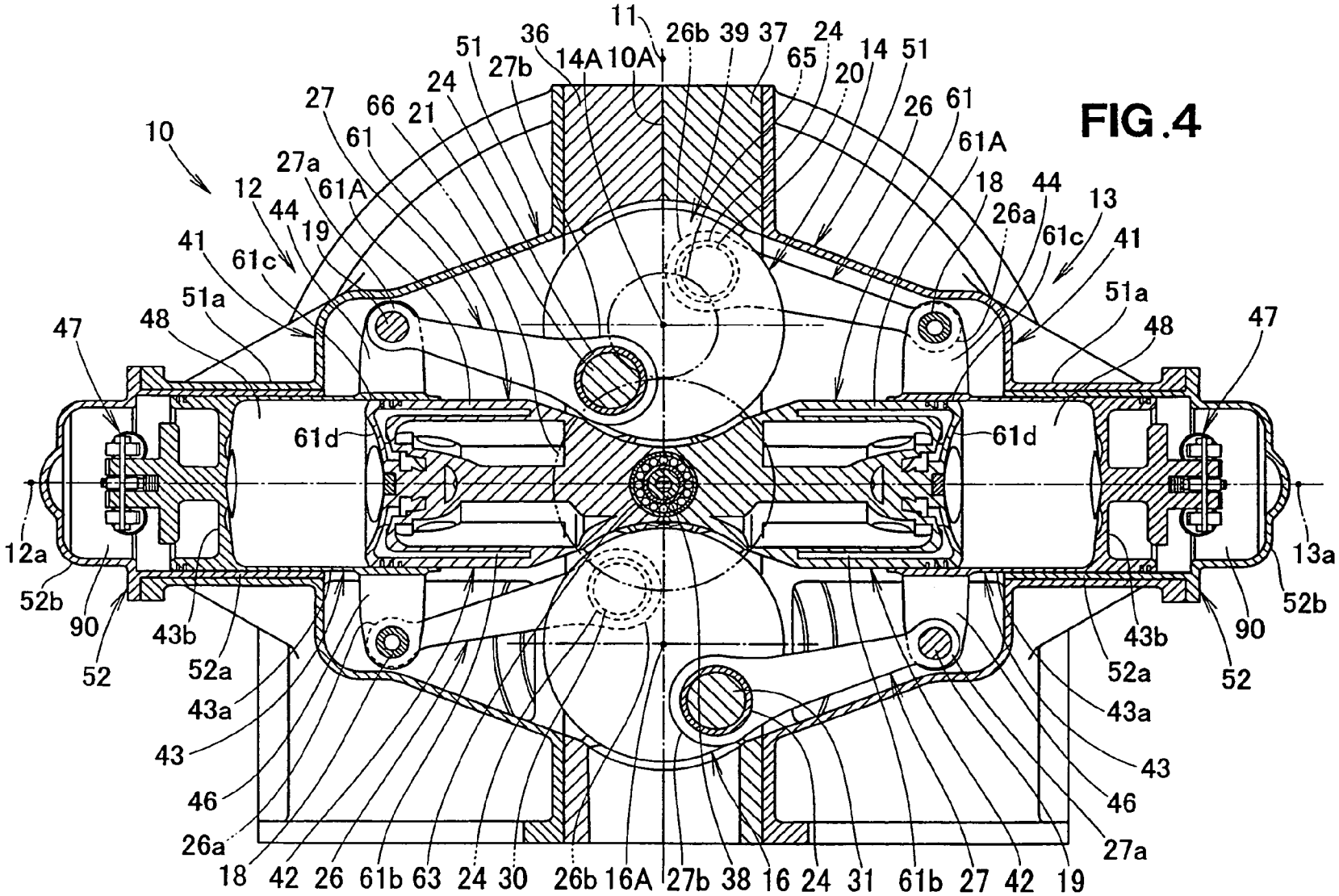
FIG. 4 is a cross-sectional view as seen from the rear of the internal combustion engine.

As shown in FIG. 4, the internal combustion engine 10 has the left cylinder 12, which is disposed to the left of a vertically extending center line 11 (the center line 11 passes through the matched surface 10A); the right cylinder 13, which is disposed to the right of the center line 11; the upper crankshaft 14 and the lower crankshaft 16, which are disposed in parallel to one another so as to be along and perpendicular to the center line 11; a first connecting rod 26, a second connecting rod 27, and a third connecting rod 28 (not shown; see FIG. 7), in which large end parts 26*b*, 27*b* 28*b* (the large end part 28*b* is not shown; see FIG. 7) thereof are rotatably connected to crank pins 20, 21, 22 (crank pin 22 is not shown; see FIG. 7) of the upper crankshaft 14 via bearings 24 (the bearing 24 of the large end part 28*b* is not shown); a first connecting rod 26, a second connecting rod 27, and a third connecting rod 28 (not shown; see FIG. 7), in which large end parts 26*b*, 27*b* 28*b* (the large end part 28*b* is not shown; see FIG. 7) thereof are rotatably connected to crank pins 30, 31, 32 (crank pin 30 is not shown; see FIG. 7) of the lower crankshaft 16 via bearings 24 (the bearing 24 of the large end part 28*b* is not shown); the left fixed block 36 and the right fixed block 37, which are divided in two along the center line 11 in order to rotatably support the upper crankshaft 14 and the lower crankshaft 16 via the bearings (not shown); and a cam drive mechanism 39 for driving a camshaft 38 disposed between the upper crankshaft 14 and the lower crankshaft 16. Reference number 14A denotes an axial line that extends in the axial direction through the center of the upper crankshaft 14, and reference symbol 16A denotes an axial line that extends in the axial direction and passes through the center of the lower crankshaft 16.

The left cylinder 12 and the right cylinder 13 have the same basic structure, and only the left cylinder 12 is described below.

The left cylinder 12 has the engine case 41, which is attached on the left fixed block 36; a center head 42, which protrudes from a side surface of the left fixed block 36 so as to be perpendicular to the center line 11; the moveable sleeve 43, which is configured as a bottomed tube, and is moveably fitted on the center head 42; a connecting rod connecting member 44, which is provided in order to connect the second connecting rod 27 to an outer surface 43*a* of the moveable sleeve 43; a connecting rod connecting member 46, which is provided in order to connect the first connecting rod 26 and the third connecting rod 28 (not shown; see FIG. 7) to the outer surface 43*a* of the moveable sleeve 43; and an intake valve mechanism 47, which is provided to a top part 43*b* of the moveable sleeve 43. Symbol 12*a* denotes a left cylinder axis, and symbol 13*a* denotes a right cylinder axis. These axes are perpendicular to a plane that passes through the axial line 14A of the upper crankshaft 14 and the axial line 16A of the lower crankshaft 16, and are provided so as to extend toward either side of the upper crankshaft 14 and the lower crankshaft 16. The left cylinder axis 12*a* is aligned with the center axes of the center head 42 and the moveable sleeve 43. Symbol 48 denotes a combustion chamber formed by the center head 42 and the moveable sleeve 43.

The engine case 41 has a case main body 51 and a liner cap that is fitted into a tubular part 51*a*. The tubular part 51*a* is formed in an end part of the case main body 51. The liner cap 52 has a liner part 52*a* that slides along the outer surface 43*a* of the moveable sleeve 43, and an upper wall 52*b* that is integrally formed with the liner part 52*a* in order to block an end part of the liner part 52*a*.

The center head 42 has a head main body 61, which is integrally formed with the left fixed block 36; and a valve mechanism (not shown) described below and a spark plug (not shown), which are provided to the head main body 61.

The head main body 61 has a stationary piston 61A formed on an outer peripheral part, and a coolant channel 61*b* through which coolant flows.

The stationary piston 61A is a bottomed tubular portion configured from the outer peripheral part and end part of the head main body 61. A concave crown surface 61*d* is formed in the bottom of the stationary piston. A plurality of piston ring grooves is formed in an end part of an outer peripheral surface 61*c* near the crown surface 61*d*, and piston rings are installed in the piston ring grooves.

The camshaft 38 is securely held between the left fixed block 36 and the right fixed block 37, and is rotatably supported by bearings 63.

The cam drive mechanism 39 has a camshaft drive gear 65 attached on the upper crankshaft 14, and a camshaft driven gear 66 attached on the camshaft 38 so as to mesh with the camshaft drive gear 65.

The camshaft driven gear 66 has twice as many teeth as the camshaft drive gear 65, and rotates at ½ the rate at which the camshaft drive gear 65 rotates.

Since the internal combustion engine 10 is a four-cycle engine, the camshaft 38 thus rotates once for every two rotations of the upper crankshaft 14.

For example, if the internal combustion engine 10 is a two-cycle engine, the camshaft 38 will rotate once for every rotation of the upper crankshaft 14.

Figure 5:
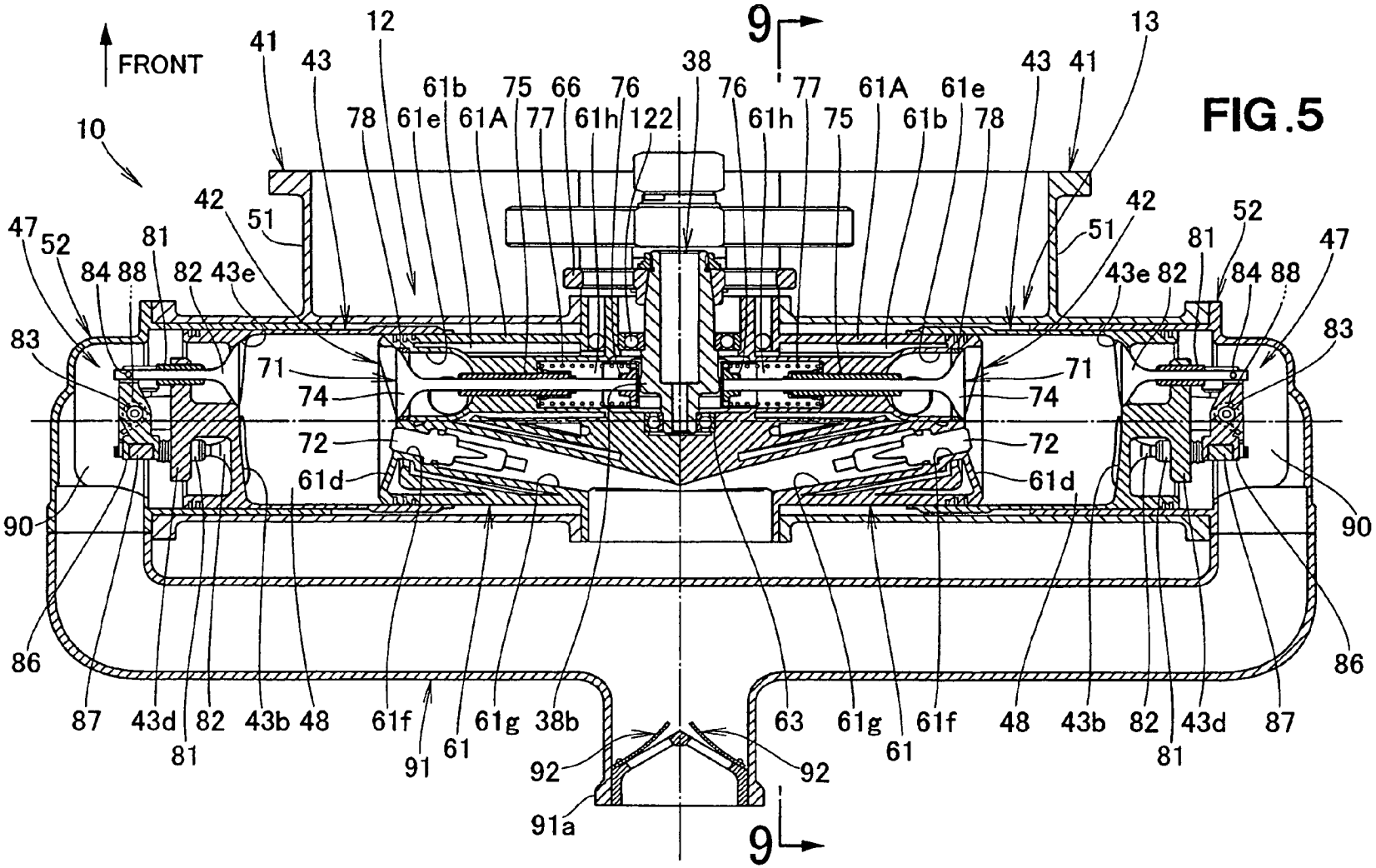
FIG. 5 is a cross-sectional view as seen from the top of the internal combustion engine.

As shown in FIG. 5, the center head 42 has a valve mechanism 71 and a spark plug 72. The head main body 61 of the center head 42 has an exhaust port 61*e* that is formed in the crown surface 61*d*, and a thread 61*f* and a plug insertion hole 61*g* into which the spark plug 72 is inserted.

The valve mechanism 71 has an exhaust valve 74 for opening and closing an inlet of the exhaust port 61*e*; a valve guide 75 attached on the head main body 61 in order to moveably support the exhaust valve 74; a valve spring 77 interposed between a bottom of an empty space 61*h* formed in the head main body 61, and a spring hanger member 76 formed on the end of the shaft of the exhaust valve 74, in order to urge the exhaust valve 74 to the closing side; and a hollow camshaft 38 for directly driving the exhaust valve 74 via a cam 38*b*. Reference number 78 denotes an annular valve seat on which the exhaust valve 74 rests, and the opening of the exhaust port 61*e* is formed in the valve seat.

Annular coolant channels 61*b* are formed around each of the exhaust port 61*e*, the exhaust valve 74, and the spark plug 72; and portions that reach high temperatures are better able to be cooled.

The intake valve mechanism 47 has a valve supporting part 43*d* integrally formed in the top part 43*b* of the moveable sleeve 43; three valve guides 81 (two valve guides 81 are shown in the present embodiment) attached on the valve support part 43*d*; intake valves 82 (two intake valves 82 are shown in the present embodiment) moveably inserted in the valve guides 81 in order to open and close three intake holes 43*e* (one intake hole 43*e* is shown here) formed in the top part 43*b* of the moveable sleeve 43; a single rocker shaft 83 attached on the valve support part 43*d*; three rocker arms 86 (one rocker arm 86 is shown here) that are pivotably attached on the rocker shaft 83, and that have one end connected to the intake valves 82 via connecting pins 84; weights 87 attached on the other ends of the rocker arms 86; and three torsion coil springs 88 (one torsion coil spring 88 is shown here) provided between the valve support part 43*d* and the rocker arms 86 in order to close the intake valves 82 using a small amount of urging force.

The weight 87 is used in order to balance the intake valves 74 so that they do not move as a result of inertia when the moveable sleeve 43 is caused to move back and forth.

The liner cap 52 and the top part 43*b* of the moveable sleeve 43 are components that form an intake chamber 90 into which a mixed gas containing fuel and air is drawn. An intake manifold 91 is connected to the intake chamber 90 of the left cylinder 12 and the intake chamber 90 of the right cylinder 13. A pair of leaf valves 92, 92 is provided to the inlet 91*a* of the intake manifold 91 as a one-way valve for only allowing the mixed gas to flow from a throttle body (not shown) connected to the intake manifold 91 to the intake chambers 90, 90.

Figure 6:
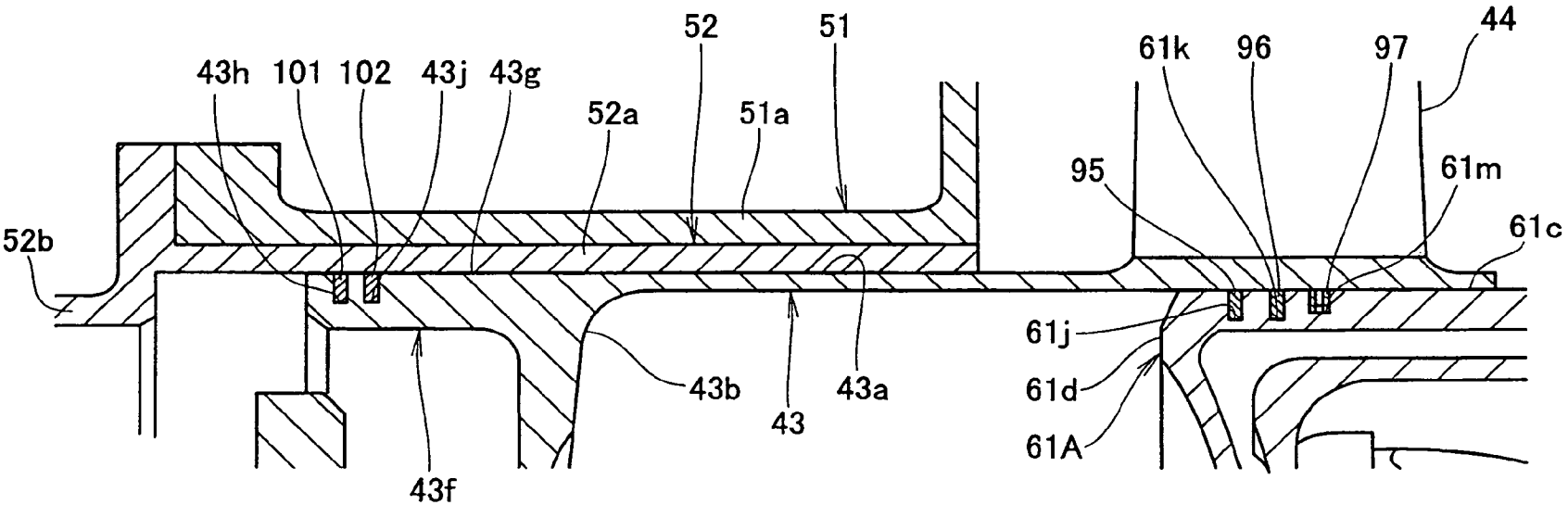
FIG. 6 is a partial cross-sectional view showing a seal structure of the moving parts of the internal combustion engine.

As shown in FIG. 6, an annular top ring groove 61*j*, an annular secondary ring groove 61*k*, and an annular oil ring groove 61*m* are formed in the stated order from the crown surface 61*d* on the outer surface 61*c* of the stationary piston 61A. An annular top ring 95 is fitted in the top ring groove 61*j*. An annular secondary ring 96 is fitted in the secondary ring groove 61*k*. An annular oil ring 97 is fitted in the oil ring groove 61*m*. The space between the stationary piston 61A and the moveable sleeve 43 is sealed and lubricating oil is scraped off by the top ring 95, the secondary ring 96, and the oil ring 97.

A tubular land part 43*f* is integrally formed with the moveable sleeve 43 closer to the upper wall 52*b* of the liner cap 52 than the top part 43*b*. Annular seal ring grooves 43*h*, 43*j* are formed in an outer peripheral surface 43*g* of the land part 43*f*. An annular seal ring 101 is fitted in the seal ring groove 43*h*, and a seal ring 102 is fitted in the seal ring groove 43*j*. The space between the moveable sleeve 43 and the liner part 52*a* of the liner cap 52 is sealed and lubricating oil is scraped off by the seal rings 101, 102.

Figure 7:
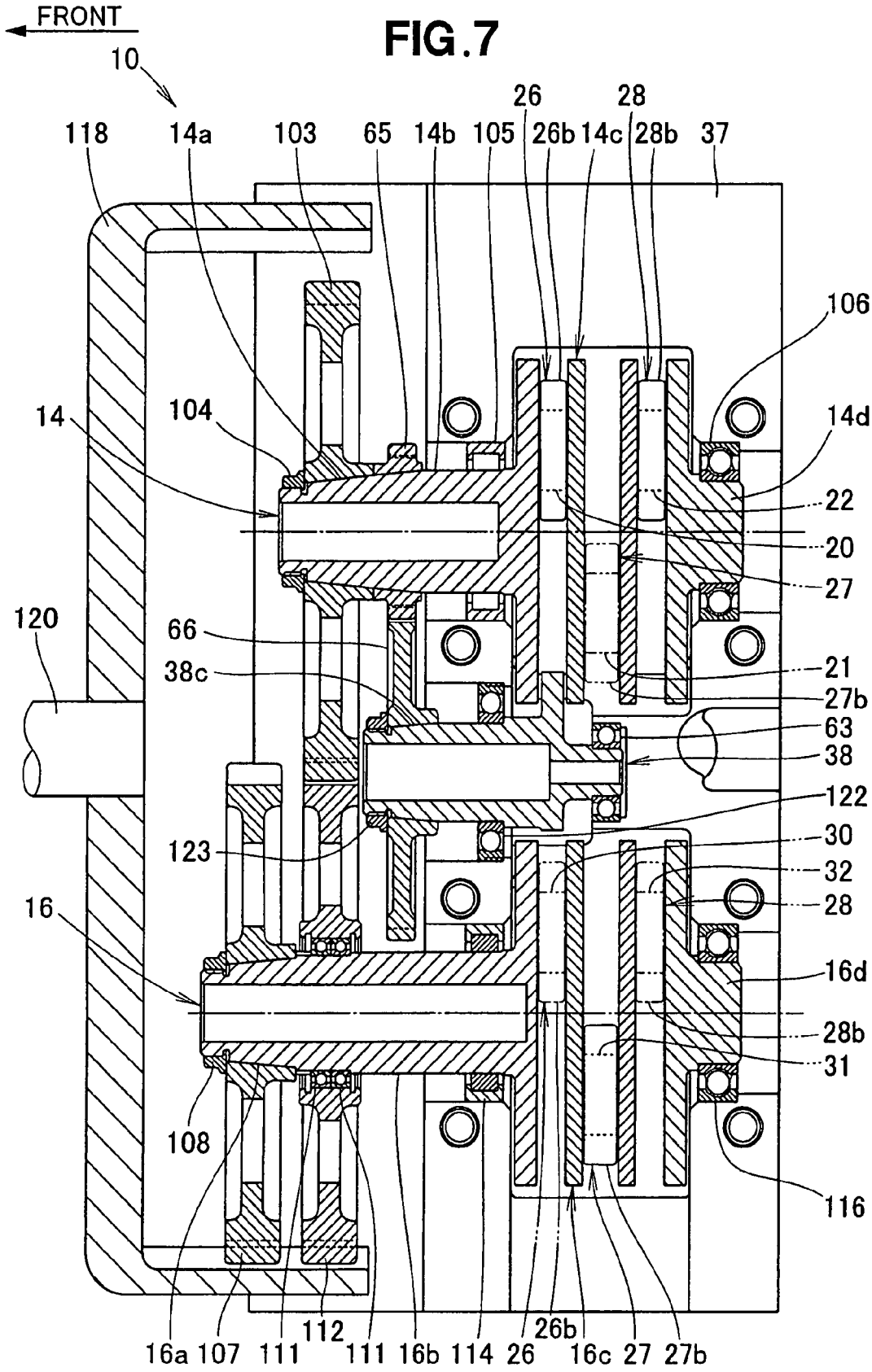
FIG. 7 is a cross-sectional view of the internal combustion engine as seen from the side.

As shown in FIG. 7, the upper crankshaft 14 has a tapered shaft 14*a*, a front journal shaft 14*b*, a crank part 14*c*, and a rear journal shaft 14*d*. An upper crank output gear 103 is attached to the taper shaft 14*a* by a nut 104. The front journal shaft 14*b* is rotatably attached to the left fixed block 36 (not shown) and the right fixed block 37 via a roller bearing 105. A first connecting rod 26, a second connecting rod 27, and a third connecting rod 28 are connected to crank pins 20, 21, 22 provided to the crank part 14*c*. The rear journal shaft 14*d* is rotatably attached to the left fixed block 36 and the right fixed block 37 via a ball bearing 106.

The upper crankshaft 16 has a tapered shaft 16*a*, a front journal shaft 16*b*, a crank part 16*c*, and a rear journal shaft 16*d*. A lower crank output gear 107 is attached to the taper shaft 16*a* by a nut 108. An idler gear 112 is rotatably attached to a front part of the front journal shaft 16*b* via ball bearings 111, 111. A rear part of the front journal shaft 16*b* is rotatably attached to the left fixed block 36 and the right fixed block. A first connecting rod 26, a second connecting rod 27, and a third connecting rod 28 are connected to crank pins 30, 31, 32 provided to the crank part 16*c*. The rear journal shaft 16*d* is rotatably attached to the left fixed block 36 and the right fixed block 37 via a ball bearing 116.

The upper crank output gear 103 meshes with the idler gear 112. The lower crank output gear 107 and the idler gear 112 mesh with inner teeth of a ring gear 118 disposed in front of the upper crank output gear 103 and the lower crank output gear 107.

The output of the upper crankshaft 14 is outputted via the upper crank output gear 103, the idler gear 112 and the ring gear 118 to an output shaft 120, which is attached on the ring gear 118. The output of the lower crankshaft 16 is output to an output shaft 120 via the lower crank output gear 107 and the ring gear 118. The output shaft 120 is rotatably supported by the left fixed block 36 and the right fixed block 37 via a bearing (not shown).

The camshaft 38 is rotatably supported by the left fixed block 36 and the right fixed block 37 via the bearings 63, 122. Reference number 123 denotes a nut for attaching the camshaft driven gear 66 to a tapered part 38*c* of the camshaft 38.

The following is a summary of the operation of the internal combustion engine 10 described above.

In FIG. 4, FIG. 5, and FIG. 7, when, for example, a mixed gas comprising fuel and air is supplied to the combustion chamber 48 via the intake manifold 91 and the intake chamber 90 in the left cylinder 12, and the mixed gas is ignited in the combustion chamber. The pressure inside the combustion chamber 48 increases, and the moveable sleeve 43 moves toward the bottom dead center position; i.e., toward the upper wall 52*b* of the liner cap 52, with respect to the center head 42.

At this time, the upper crankshaft 14 and the lower crankshaft 16 are made to rotate by the first through third connecting rods 26, 27, 28, which are attached to the moveable sleeve 43 via the connecting rod connecting members 44, 46. The upper crankshaft 14 rotates in the opposite direction of the lower crankshaft 16.

The rotation of the upper crankshaft 14 and the lower crankshaft 16 is transferred to the exterior of the internal combustion engine 10 from the output shaft 120 via the upper crank output gear 103, the idler gear 112, the lower crank output gear 107, and the ring gear 118. The rotation is maintained by the moment of inertia of the upper crankshaft 14 and lower crankshaft 16, the upper crank output gear 103, the idler gear 112, the lower crank output gear 107, and the ring gear 118. The camshaft driven gear 66 is made to rotate by the rotation of the camshaft drive gear 65. The cam 38*b* of the camshaft 38 drives the exhaust valves 74, 74, and combustion gas is discharged at a prescribed timing. When the moveable sleeve 43 described above moves toward bottom dead center, the mixed gas in the intake chamber 90 is compressed by the moveable sleeve 43, and passes through the intake manifold 91 to the intake chamber 90 of the right cylinder 13. The intake valves 74 are opened, and the mixed gas is charged into the combustion chamber 48. The moveable sleeve 43 is thereby caused to continuously move back and forth.

When the moveable sleeve 43 moves back and forth, the center head 42 in particular reaches high temperatures due to the combustion heat generated in the combustion chamber 48 and heat generated by the sliding of the components. Coolant is accordingly made to circulate through the coolant channel 61*b*, whereby cooling is performed.

Figure 8:
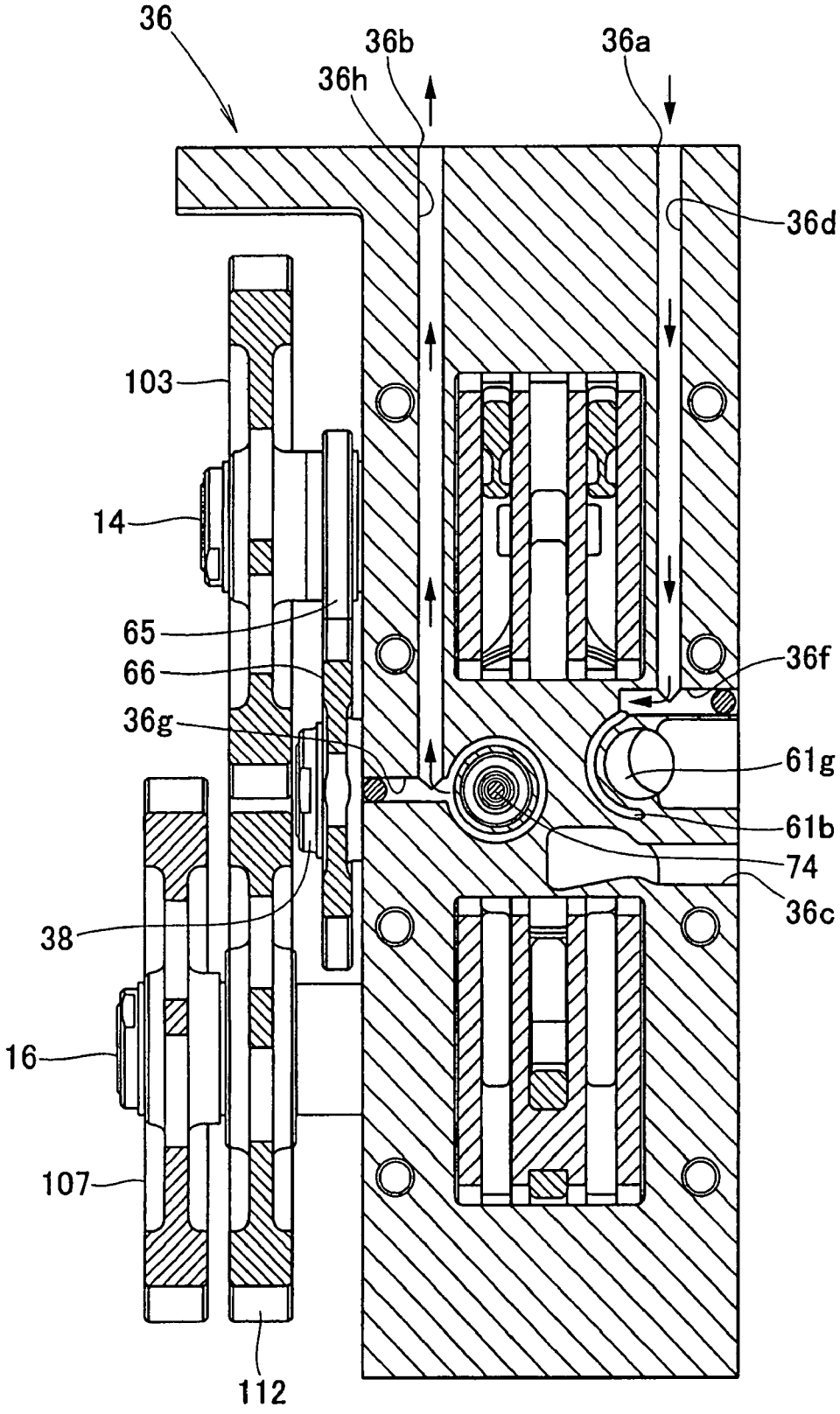
FIG. 8 is a cross-sectional view taken along line 8-8 of FIG. 1.

As shown in FIG. 8, the left fixed block 36 has a coolant channel 36*d*, which extends downward from the coolant inlet 36*a*; a coolant channel 36*f*, which is connected to the coolant channel 36*d* so as to be perpendicular thereto, and which is connected to the coolant channel 61*b*, which annularly extends around the spark plug 72 (see FIG. 5), and the intake valves 74 (see FIG. 5); a horizontally extending coolant channel 36, which is connected to the coolant channel 61*b*; and a coolant channel 36*h*, which extends upward to the coolant inlet 36*b* from a coolant channel 36*g* so as to be perpendicular thereto. The right fixed block 37 is provided with similar coolant channels.

Figure 9A:
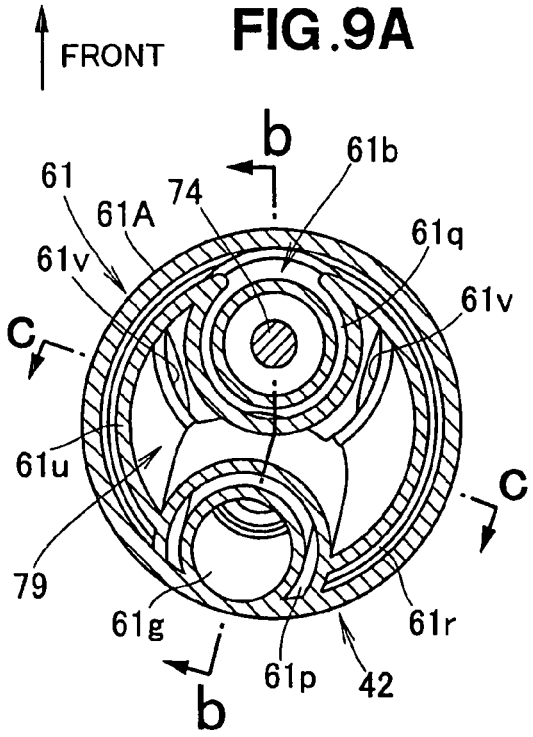
FIG. 9 is a cross-sectional view showing a coolant channel of the internal combustion engine.

As shown in FIG. 9A, the coolant channel 61*b* has a first channel 61*p*, which surrounds the plug insertion hole 61*g* through which the spark plug 72 is inserted (see FIG. 5); a second channel 61*q*, which surrounds the exhaust valve 74; and a third channel 61*r* annularly inside the stationary piston 61A.

An exhaust channel 79 is formed inside an inner wall 61*u* positioned inside the first channel 61*p*, the second channel 61*q*, and the third channel 61*r*. An exhaust port 61*e*, which extends from the exhaust valve 74, is connected to the exhaust channel 79 via two exhaust port through-holes 61*v* that pass through the exhaust port 61*e*.

The exhaust channel 79 is connected to the exhaust outlets 36*c*, 37*c* (both shown in FIG. 3) described above.

Figure 9B:
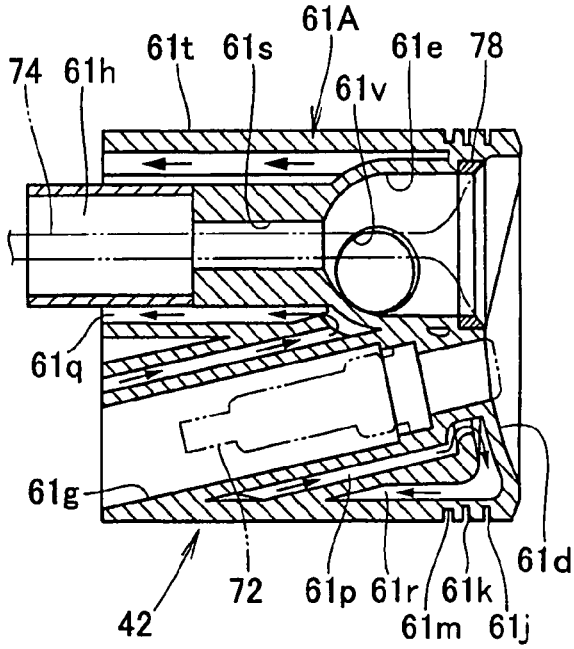

As shown in FIG. 9B, the first channel 61*p* is formed around the plug insertion hole 61*g*. The second channel 61*q* is formed around the exhaust port 61*e*, a valve guide insertion hole 61*s*, and the empty space 61*h*. The third channel 61*r* is formed inside the side wall 61*t* and the crown surface 61*d* of the stationary piston 61A.

Figure 9C:
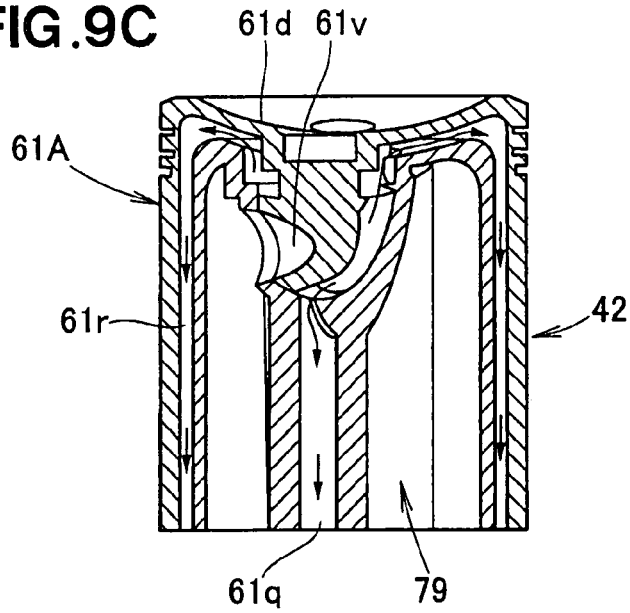

As shown in FIG. 9C, the third channel 61*r* is a portion formed along the crown surface 61*d* in the vicinity thereof. The crown surface 61*d*, which reaches high temperatures as a result of being subjected to combustion heat from the combustion chamber 48 (see FIG. 5), can be effectively cooled by coolant that flows through the third channel 61*r*.

The action of each stroke of the internal combustion engine 10 described above will be described below. The letter "L" has been added at the end of the symbols of the components in the left cylinder 12, and the letter "R" has been added at the end of the symbols of the components in the right cylinder 13.

Figure 10A:
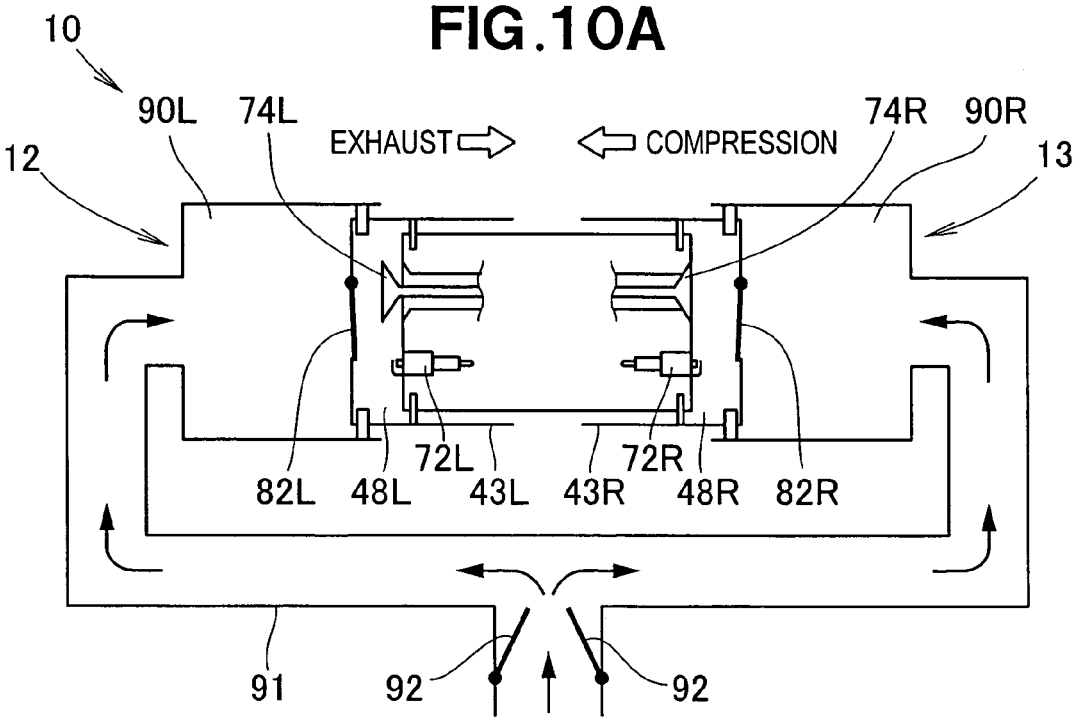
FIG. 10A is an operation diagram showing an exhaust stroke in the left cylinder and a compression stroke in the right cylinder in the internal combustion engine.

FIG. 10A shows a state in which the moveable sleeves 43L, 43R of the left cylinder 12 and right cylinder 13 are moved toward the center of the internal combustion engine 10, and the moveable sleeves 43L, 43R reach top dead center.

The exhaust valve 74L is open and the intake valve 82L is closed in the left cylinder 12 until top dead center is reached, and combustion gas that has exploded within the combustion chamber 48L is discharged. The exhaust valve 74L is and the intake valve 82L are closed in the right cylinder 13, the spark plug 72R is ignited before the engine reaches top dead center, and the mixed gas is caused to explode. The moveable sleeve 43R moves from top dead center to bottom dead center as result of the increase of pressure within the combustion chamber 48R.

As a consequence of the moveable sleeves 43L, 43R moving toward top dead center, pressure decreases within the intake chambers 90L, 90R of the left cylinder 12 and the right cylinder 13. Therefore, the leaf valves 92, 92 in the intake manifold 91 open, and the mixed gas flows into the intake chambers 90L, 90R as shown by the arrow.

Figure 10B:
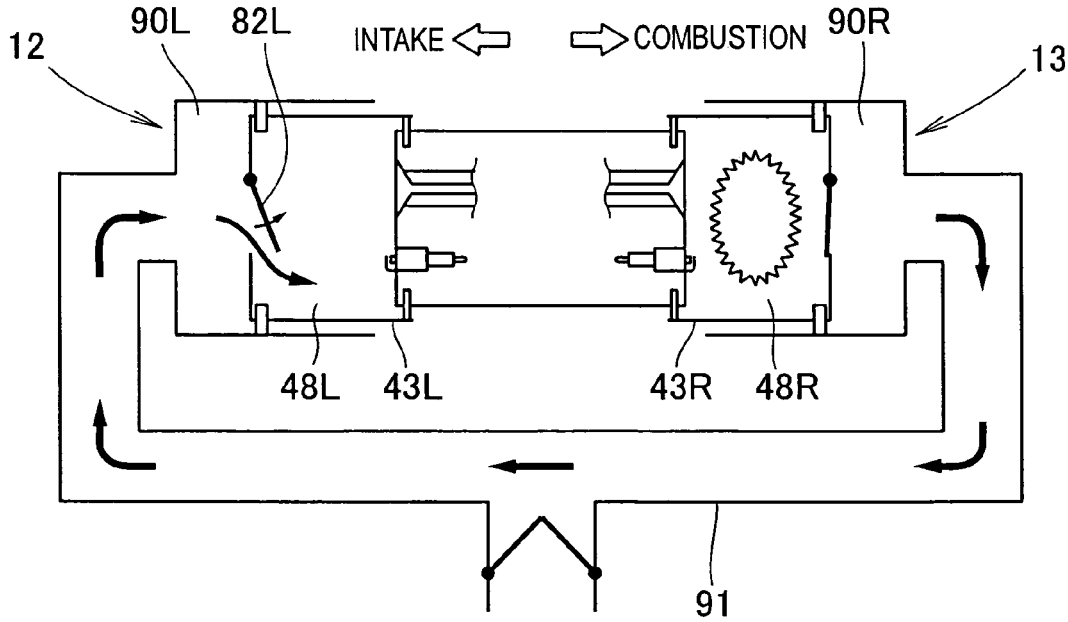
FIG. 10B is an operation diagram showing an intake stroke in the left cylinder and a combustion stroke in the right cylinder in the combustion engine.

As shown in FIG. 10B, the mixed gas in the intake chamber 90R is compressed when the moveable sleeve 43R of the right cylinder 13 moves to bottom dead center as a result of the high pressure generated by the combustion of the mixed gas in the combustion chamber 48R. As a result, the mixed gas moves from the intake chamber 90R, through the channels in the exhaust manifold 91, and into the intake chamber 90L in the left cylinder 12. While the moveable sleeve 43 of the left cylinder 12 moves from top dead center to bottom dead center, the intake valve 82L opens due to the pressure within the intake chamber 90L, and the intake gas flows into the combustion chamber 48L. In other words, the mixed gas continuously flows into the combustion chamber 48L of the left cylinder 12.

Figure 11A:
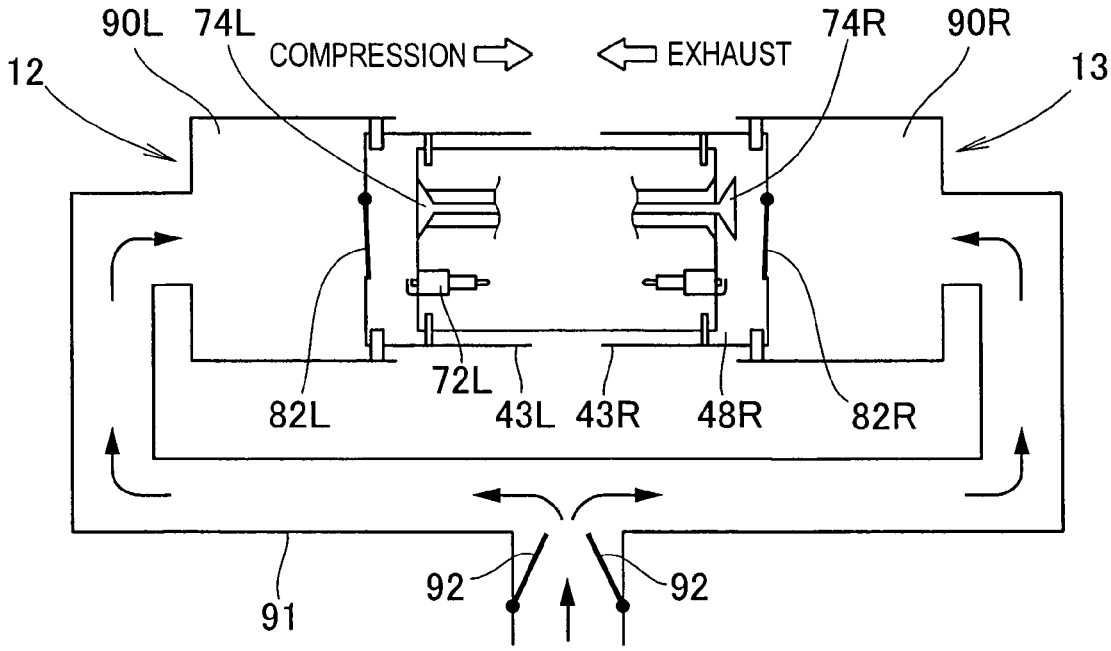
FIG. 11A is an operation diagram showing a compression stroke in the left cylinder and an exhaust stroke in the right cylinder in the internal combustion engine.

FIG. 11A shows a state in which the moveable sleeves 43L, 43R of the left cylinder 12 and the right cylinder 13 have once again reached top dead center. The exhaust valve 74L and the intake valve 82L in the left cylinder 12 are closed until top dead center is reached. The spark plug 72L is ignited and the mixed gas explodes before top dead center is reached. The moveable sleeve 43L moves from top dead center to bottom dead center in concert with the increase in pressure in the combustion chamber 48L. In the right cylinder 13, the exhaust valve 74R opens and the intake valve 82R closes, and combustion gas that has exploded within the combustion chamber 48R is discharged.

As a consequence of the moveable sleeves 43L, 43R moving toward top dead center, in pressure decreases within the intake chambers 90L, 90R of the left cylinder 12 and the right cylinder 13. Therefore, the leaf valves 92, 92 in the intake manifold 91 open, and the mixed gas flows into the intake chambers 90L, 90R as shown by the arrow.

Figure 11B:
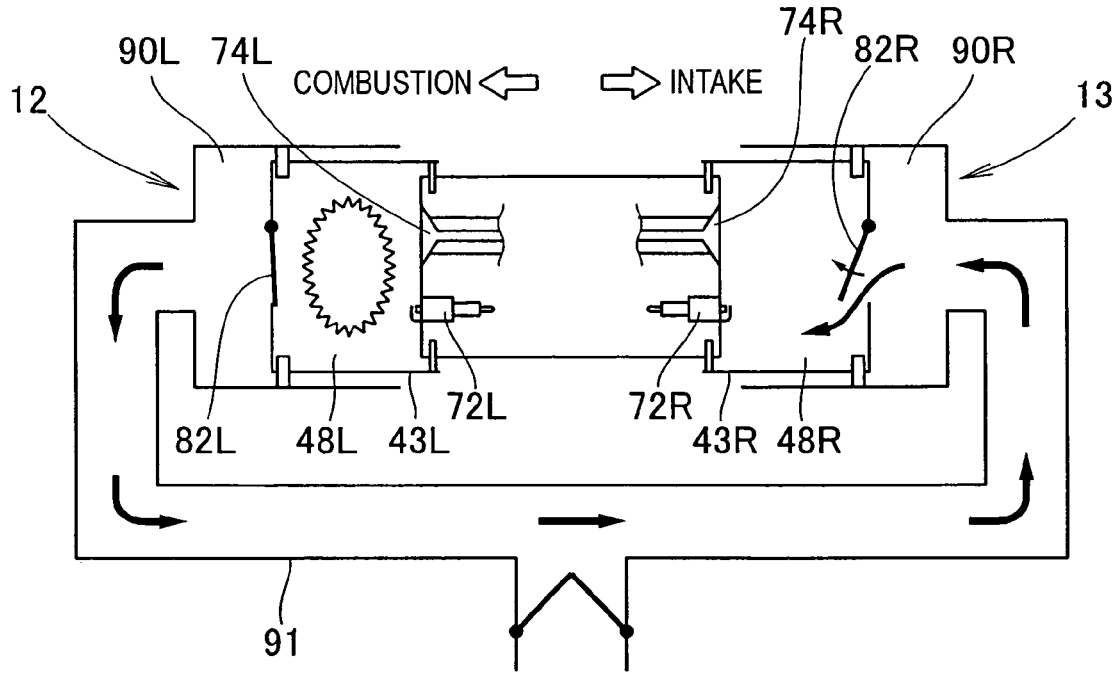
FIG. 11B operation diagram showing a combustion stroke in the left cylinder and an intake stroke in the right cylinder in the internal combustion engine.
Figure 12:
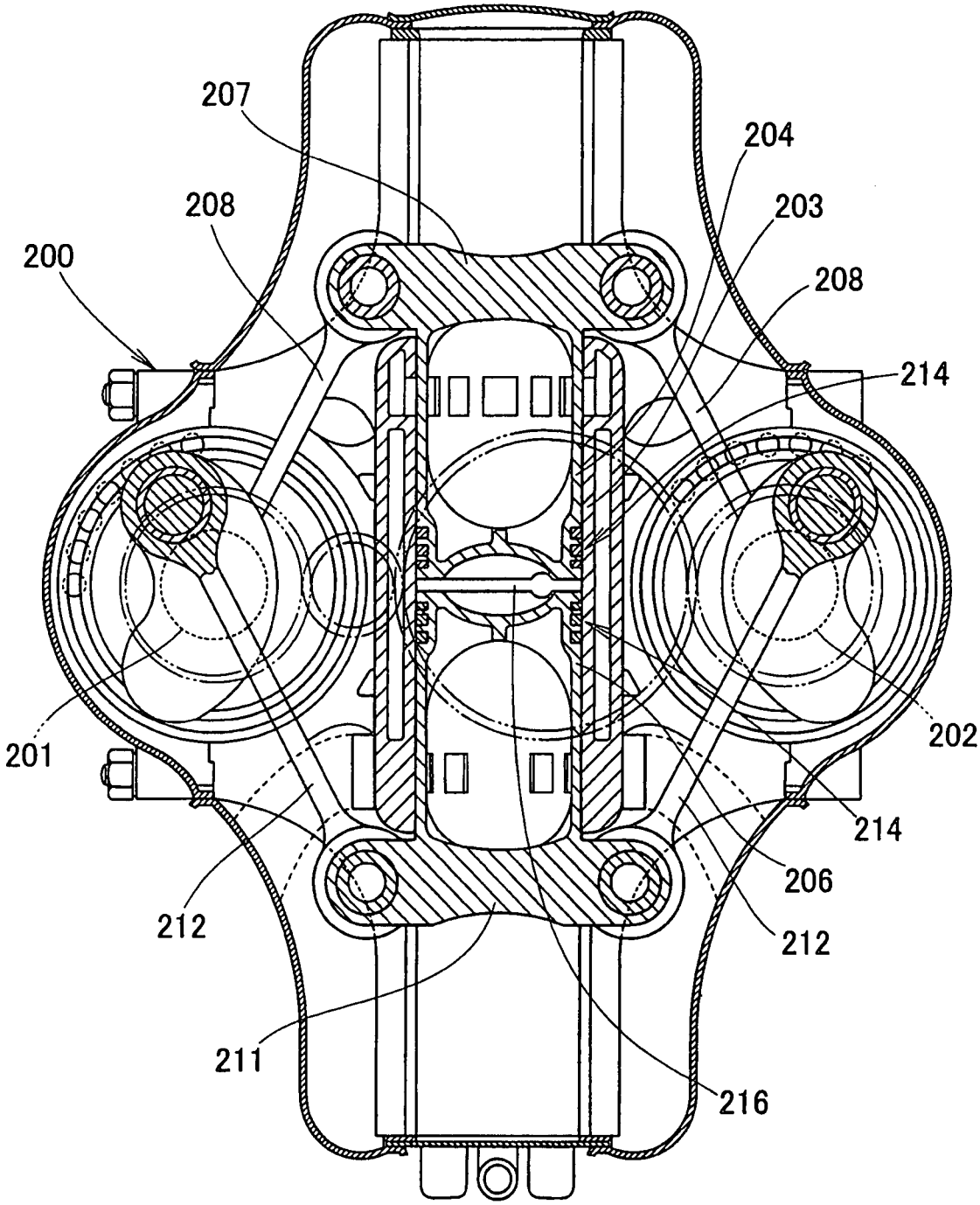
FIG.12 (PRIOR ART)
FIG. 12 is a cross-sectional view of a conventional internal combustion engine as seen from the front.

As shown in FIG. 11B, the mixed gas in the intake chamber 90L is compressed when the moveable sleeve 43L of the left cylinder 12 moves to bottom dead center as a result of the high pressure generated by the combustion of the mixed gas in the combustion chamber 48L. As a result, the mixed gas moves from the intake chamber 90L, through the channels in the exhaust manifold 91, and into the intake chamber 90R in the right cylinder 13. While the moveable sleeve 43 of the right cylinder 13 moves from top dead center to bottom dead center, the intake valve 82R opens due to the pressure within the intake chamber 90R, and the intake gas flows into the combustion chamber 48R. In other words, the mixed gas continuously flows into the combustion chamber 48R of the right cylinder 13.

The flow of coolant through the coolant channels in the center head 42 described above is illustrated in FIG. 8 and FIG. 9. A description will be provided hereunder of the left fixed block 36 and the left cylinder 12. The right fixed block 37 and the right cylinder 13 are identical to the left fixed block 36 and the left cylinder 12, and descriptions thereof have been omitted.

In FIG. 8, coolant flows from the coolant inlet 36*a* to the coolant channel 61*b* through the coolant channel 36*d* and the coolant channel 36*f*, as shown by the arrow.

Coolant in the coolant channel 61*b* flows toward the crown surface 61*d* through the first channel 61*p* around the plug insertion hole 61*g*, and cools both the spark plug 72 and the area surrounding same, as shown in FIG. 9B. As shown in FIG. 9B and FIG. 9C, coolant flows through the third channel 61*r*, which extends from the first channel 61*p* along the crown surface 61*d*, and cools the crown surface 61*d* and the side wall 61*t*, and particularly the top ring groove 61*j*, the secondary ring groove 61*k*, the oil ring groove 61*m*, the top ring 95 (see FIG. 6), the secondary ring 96 (see FIG. 6), and the oil ring 97 (see FIG. 6). Coolant also flows through the second channel 61*q* around the exhaust valve 74 and cools the exhaust valve 74 and the area surrounding same.

The coolant then flows from the coolant channel 61*b* to the coolant outlet 36*c* through the coolant channel 36*g* and the coolant channel 36*h*.

Obviously, various minor changes and modifications of the present invention are possible in light of the above teaching. It is therefore to be understood that within the scope of the appended claims the invention may be practiced otherwise than as specifically described.

What is claimed is:

1. An internal combustion engine comprising:

two rotatable crankshafts horizontally disposed in an engine case in vertically spaced relation to each other;

two stationary pistons disposed between the two crankshafts and extending perpendicularly to a plane that passes over axial lines of the two crankshafts;

moveable sleeves slidably attached to the respective stationary pistons; and combustion chambers surrounded by the stationary pistons and the moveable sleeves, wherein each of the stationary pistons has a piston ring disposed on a exterior surface thereof for sealing between the stationary piston and the respective moveable sleeve, and the two crankshafts and the two moveable sleeves are interconnected via respective connecting rods.

2. The internal combustion engine of claim 1, wherein the engine case includes a case cylinder in which the moveable sleeves are moveably fitted, and an upper wall for blocking an end part of the case cylinder, each of the moveable sleeves includes a seal ring disposed on an outer surface thereof for sealing between the moveable sleeve and the case cylinder, and the moveable sleeve, the case cylinder and the upper wall jointly define an intake chamber for admitting a mixed gas containing fuel and air, so that the mixed gas is supplied from the intake chamber to the combustion chamber.

* * * * *